US009013356B2

(12) United States Patent
Wang et al.

(10) Patent No.: US 9,013,356 B2
(45) Date of Patent: Apr. 21, 2015

(54) HANDHELD DEVICE

(75) Inventors: Ching-Sung Wang, Taoyuan County (TW); Huang-Jen Chen, Taoyuan County (TW); Bing-Hsiao Wang, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 839 days.

(21) Appl. No.: 12/769,628

(22) Filed: Apr. 28, 2010

(65) Prior Publication Data

US 2011/0193752 A1 Aug. 11, 2011

(30) Foreign Application Priority Data

Feb. 10, 2010 (TW) ..... 99104158 A

(51) Int. Cl.
*H01Q 1/24* (2006.01)
*H01Q 9/04* (2006.01)

(52) U.S. Cl.
CPC ..... *H01Q 1/243* (2013.01); *H01Q 1/242* (2013.01); *H01Q 9/0421* (2013.01)

(58) Field of Classification Search
CPC ..... H01Q 1/243; H01Q 9/0421
USPC ..... 343/702, 872, 873
See application file for complete search history.

(56) References Cited

U.S. PATENT DOCUMENTS 5,918,189 A * 6/1999 Kivela ..... 455/575.1
6,028,555 A * 2/2000 Harano ..... 343/702
2003/0146878 A1* 8/2003 Mikkola et al. ..... 343/702
2005/0017909 A1* 1/2005 Carpenter et al. ..... 343/702
2006/0017622 A1* 1/2006 Zinanti et al. ..... 343/700 MS
2006/0111075 A1* 5/2006 Seol ..... 455/343.6
2007/0109204 A1* 5/2007 Phillips et al. ..... 343/702
2009/0195468 A1* 8/2009 Croman ..... 343/767
2009/0213030 A1* 8/2009 Hynes et al. ..... 343/906
2011/0012712 A1* 1/2011 Khozyainov ..... 340/10.1

FOREIGN PATENT DOCUMENTS

| | | |
|---|---|---|
| CN | 1416222 | 5/2003 |
| CN | 1114239 | 7/2003 |
| CN | 101083477 | 12/2007 |
| DE | 102008038251 | 3/2009 |
| EP | 0833455 | 4/1998 |

(Continued)

OTHER PUBLICATIONS

"Extended Search Report of Europe Counterpart Application," Issued on Jul. 20, 2010, p. 1-p. 4.

(Continued)

*Primary Examiner* — Graham Smith
(74) *Attorney, Agent, or Firm* — Jianq Chyun IP Office

(57) ABSTRACT

A handheld device is disclosed, which includes an appearance part, a system ground plane and a detachable element. The detachable element includes a carrier and a planar antenna. The system ground plane is disposed in the appearance part and has a feed point. The planar antenna is disposed on the carrier and has a connection point. The carrier is detachably connected to the appearance part. When the carrier is connected to the appearance part, the above-mentioned connection point is electrically connected to the feed point. In this way, the radiation performance of the antenna can be improved and the frequency band of the antenna of the handheld device can be changed by replacing the detachable element.

18 Claims, 6 Drawing Sheets

(56) References Cited

FOREIGN PATENT DOCUMENTS

| | | |
|---|---|---|
| EP | 0875100 | 11/1998 |
| EP | 1308824 | 5/2003 |
| EP | 1662606 | 5/2006 |
| TW | 569491 | 1/2004 |
| TW | M373574 | 2/2010 |
| WO | 0227859 | 4/2002 |
| WO | 2005011054 | 2/2005 |

OTHER PUBLICATIONS

"First Office Action of Europe Counterpart Applition," Issued on Jul. 26, 2010, p. 1-p. 7.

"First Office Action of China Counterpart Application", issued on Mar. 5, 2013, p. 1-p. 7.

"Office Action of Taiwan Counterpart Application", issued on Jan. 18, 2013, p. 1-p. 7.

* cited by examiner

HANDHELD DEVICE

CROSS-REFERENCE TO RELATED APPLICATION

This application claims the priority benefit of Taiwan application serial No. 99104158, filed on Feb. 10, 2010. The entirety of the above-mentioned patent application is hereby incorporated by reference herein and made a part of this specification.

BACKGROUND OF THE INVENTION

1. Field of the Invention

The subject application generally relates to a handheld device, and more particularly, to a handheld device where a planar antenna is integrated into a detachable element thereof.

2. Description of Related Art

Currently, the popular communication has been gradually progressed to wireless communication, wherein the wireless communication devices more and more tend to variety such as smart mobile phone, multimedia player, PDA (personal digital assistant) and aviation GPS (global positioning system), and the like. Various electronic apparatuses with wireless transmission function are getting improved towards the light-slim-short-small design principle so as to better adopt our daily lives. It should be noted that an antenna serves as an indispensable component for many wireless communication systems. In particular, the antenna is a major key component relating to the integrated performance of the wireless communication system.

Taking a mobile phone as an example, in order to make it more compact, a mobile phone usually employs a planar antenna, which is disposed in a housing or a cover thereof and therefore is easier to be affected by other components and sub-assemblies of the mobile phone. The affecting components include, for example, speaker), battery or connector. Certainly, the height required by clearance of the planar antenna is also one of the key factors; i.e., the higher the clearance, the better radiation performance of the planar antenna is.

However, the space of a mobile phone is limited where it is quite uneasy to increase the height/volume to the clearance of the mobile phone.

On the other hand, various countries in the world have their own and often different communication specifications, referring to the following table. In Europe, for example, the frequency band in the communication technical specification of the second generation mobile phone (2 G communication technical specification) is specified as 880-960 MHz and 1710-1880 MHz, while the frequency band in the communication technical specification of the third generation mobile phone (3 G communication technical specification) is specified as 1920-2170 MHz and 880-960 MHz. In United States, the frequency band in the 2 G communication technical specification is specified as 824-894 MHz, while the frequency band in the 3 G communication technical specification is specified as 1850-1990 MHz and 824-894 MHz.

TABLE 1

The communication specifications of Europe and USA

| | 2G | | 3G | |
|---|---|---|---|---|
| Europe | 900<br>880-960 MHz | 1800<br>1710-1880 MHz | Band 1<br>1920-2170 MHz | Band 8<br>880-960 MHz |
| USA | 850<br>824-894 MHz | 1900<br>1850-1990 MHz | Band 2<br>1850-1990 MHz | Band 5<br>824-894 MHz |

The antennas of the mobile phones in various countries are designed according to the communication specifications thereof, so that a mobile phone in the European Standard used in USA has bad radiation performance. Similarly, a mobile phone in the USA Standard used in Europe has bad radiation performance as well. In order to solve the above-mentioned problem, a user usually needs to purchase different mobile phones suitable for different countries' specifications. It should be noted that the mobile phones of different countries have different operation interfaces and different operation manners, so that the user needs to learn the different operation interfaces and operation manners to adapt different mobile phones, which bring the user great inconvenience.

SUMMARY OF THE INVENTION

Accordingly, the subject application is directed to a handheld device able to advance the signal-receiving quality of the antenna thereof and further to change the frequency band of the antenna thereof by replacing a detachable element.

The subject application provides a handheld device, which includes an appearance part, a system ground plane and a detachable element. The detachable element includes a carrier and a planar antenna. The system ground plane is disposed in the appearance part and has a feed point. The carrier is detachably connected to the appearance part. The planar antenna is disposed on the carrier and has a first connection point. When the carrier is connected to the appearance part, the first connection point is electrically connected to the feed point.

In an embodiment of the present invention, the carrier of the detachable element has a protrusion portion opposite to the system ground plane. The planar antenna extends into and is disposed within the region of the protrusion portion. When the carrier is connected to the appearance part or detached from the appearance part, the protrusion portion serves as a force-applying point.

In an embodiment of the present invention, the above-mentioned planar antenna can be disposed at an inner surface or an outer surface of the protrusion portion of the carrier or embedded in an inner layer of the protrusion portion of the carrier.

In an embodiment of the present invention, the system ground plane further has a ground point and the planar antenna further has a second connection point. When the carrier is connected to the appearance part, the second connection point is electrically connected to the ground point.

In an embodiment of the present invention, the carrier includes at least a via, i.e., a through hole. The planar antenna extends to an inner surface of the carrier from an outer surface of the carrier through the via. The first connection point is located at the inner surface of the carrier. In another embodiment, the via serves as strap hole, sound-in hole or sound-out hole.

In an embodiment of the present invention, the planar antenna is disposed at the carrier by means of molded interconnect device technology (MID technology) or laser direct structuring technology (LDS technology). In another embodiment, the planar antenna is inlaid in the carrier by means of injection molding technology. In another yet embodiment, the appearance part includes a housing, a portion of a housing or an element connected to a housing.

In an embodiment of the present invention, the appearance part includes a first locking device. The detachable element further includes a second locking device. The second locking device can lock or unlock the first locking device so that the carrier can be connected to the appearance part or detached from the appearance part.

In an embodiment of the present invention, the handheld device further includes a conductive component disposed on the system ground plane and electrically connected to the feed point. When the carrier is connected to the appearance part, the first connection point is electrically connected to the feed point through the conductive component. In another embodiment, the conductive component is a spring or a pogo pin.

In an embodiment of the present invention, the handheld device further includes a conductive component disposed on the carrier and electrically connected to the first connection point. When the carrier is connected to the appearance part, the first connection point is electrically connected to the feed point through the conductive component.

In an embodiment of the present invention, the handheld device further includes a sensing component disposed on the system ground plane for detecting whether or not the detachable element is connected to the appearance part and thereby outputting a detection signal to the system ground plane. In another embodiment, the detachable element is a portion of the appearance part or a back-cover or a battery cover of the handheld device.

The subject application also provides a handheld device, which includes an appearance part, a system ground plane and a detachable element. The system ground plane is disposed in the appearance part and has a feed point. The detachable element includes an outer carrier, a carrier and a planar antenna. The outer carrier is detachably connected to the appearance part. The carrier is connected to the outer carrier. The planar antenna is disposed on the carrier and has a connection point. When the carrier is connected to the appearance part through the outer carrier, and the above-mentioned connection point is electrically connected to the feed point.

In an embodiment of the present invention, the carrier is detachably connected to the outer carrier.

The subject application further provides a handheld device, which includes an appearance part, a system ground plane, an extended system ground plane and a detachable element. The system ground plane is disposed in the appearance part and has a feed point. The extended system ground plane is disposed in the appearance part and has a first connection point. The first connection point is electrically connected to the feed point. The detachable element includes a carrier and a planar antenna. The carrier is detachably connected to the appearance part and can be detached from the appearance part. The planar antenna is disposed on the carrier and has a second connection point. When the carrier is connected to the appearance part, the second connection point is electrically connected to the feed point through the first connection point.

The subject application further provides a handheld device, which includes an appearance part, a system ground plane, a first detachable element and a second detachable element. The system ground plane is disposed in the appearance part and has a feed point. The first detachable element includes a first carrier and a first planar antenna. The first carrier is detachably connected to the appearance part. The first planar antenna is disposed on the first carrier according to a first layout pattern and has a first connection point. When the first carrier is connected to the appearance part, the first connection point is electrically connected to the feed point. The second detachable element includes a second carrier and a second planar antenna. The second carrier is detachably connected to the appearance part. The second planar antenna is disposed on the second carrier according to a second layout pattern and has a second connection point. When the second carrier is connected to the appearance part, the second connection point is electrically connected to the feed point. The first layout pattern and the second layout pattern are different from each other.

Based on the depiction above, in the handheld device of the subject application, the planar antenna is integrated into the detachable element, which can improve the space occupied by the planar antenna and the desired radiation performance. In addition, the detachable element can be easily assembled on the appearance part of the handheld device and be detached from the appearance part. Therefore, the frequency band of the antenna of the handheld device can be changed by replacing the detachable element.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
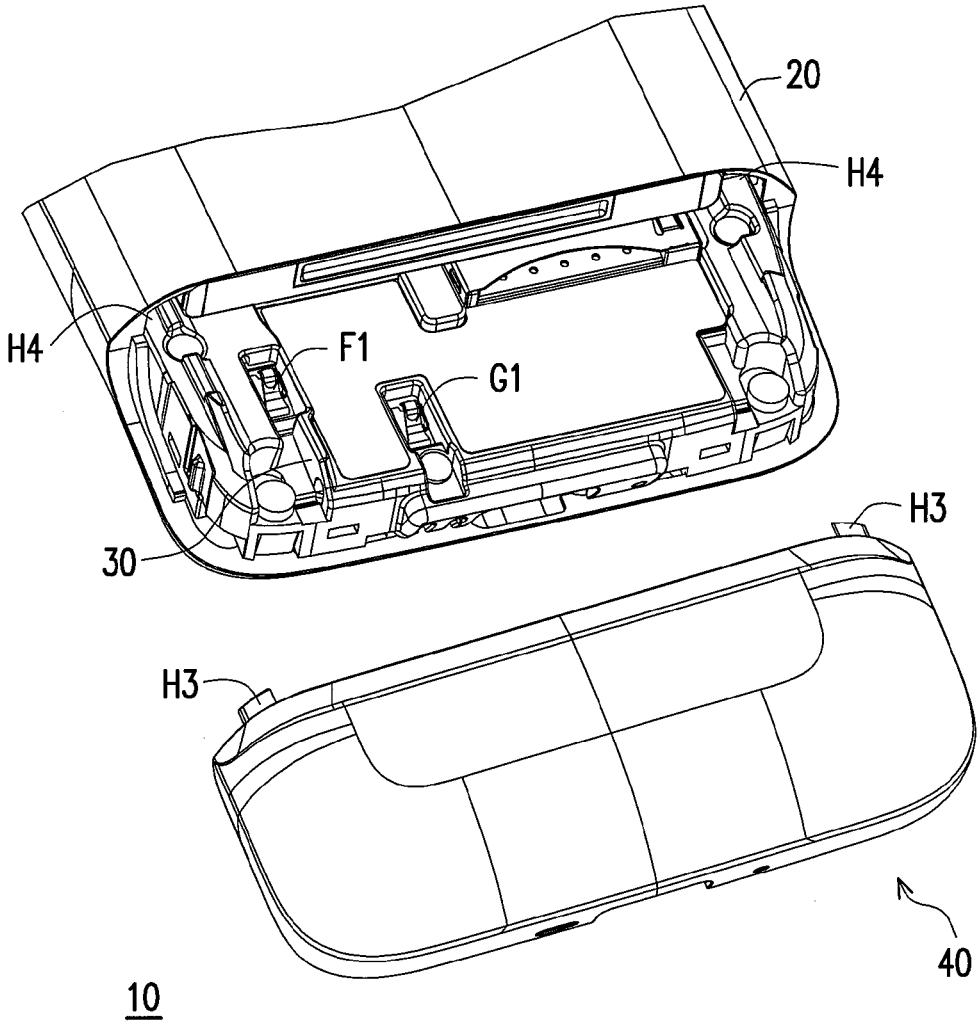
FIG. 1 is a diagram of a handheld device according to the first embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

In the prior art, a mobile phone with a small volume and a good radiation performance thereof are like people can not eat a cake and meanwhile have it. In fact, a single conventional mobile phone is unable to fit the communication specifications of all the countries in the world. The radiation performance of a single antenna in different countries is certainly different.

In the embodiments of the present invention, a planar antenna is integrated into a detachable element so that the planar antenna does not occupy the space of a system ground plane and the height between the planar antenna and the system ground plane is increased by assembling the detachable element on the appearance part of the handheld device. As a result, the radiation performance can be advanced. Since the detachable element herein can be disassembled, different planar antennas with different layout patterns can be used and disposed at different detachable elements corresponding to different communication specifications of the countries. The user can change the frequency band of the antenna of the handheld device by replacing the detachable element, which enables a single handheld device suitable for the different communication specifications of the countries. The embodiments of the present invention are explained in association with diagrams in following, wherein the diagrams are given to explain the embodiments and the same or similar steps are indicated by a same mark.

Figure 2:
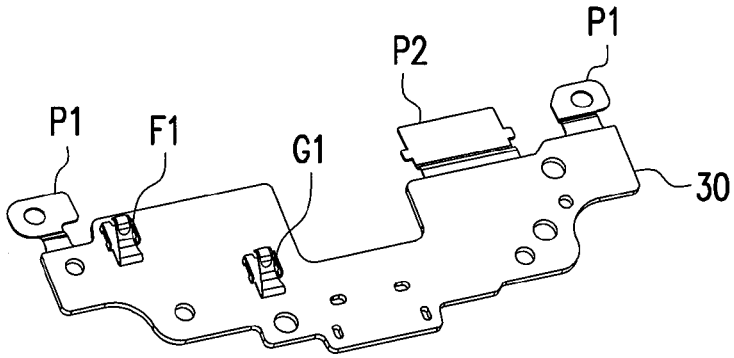
FIG. 2 is a diagram of an extended system ground plane according to the first embodiment of the present invention.

FIG. 1 is a diagram of a handheld device according to the first embodiment of the present invention and FIG. 2 is a diagram of an extended system ground plane according to the first embodiment of the present invention. Referring to FIGS. 1 and 2, in the embodiment, the handheld device takes a mobile phone as an example, which the subject application is not limited to.

A handheld device 10 mainly includes an appearance part 20 (for example, a housing, a portion of the housing or an element connected to the housing), a system ground plane (not shown) and a detachable element 40, wherein the system ground plane usually is a printed circuit board (PCB) and the detachable element 40 can be a portion of the appearance part, and the appearance part 20 can be a back-cover or a battery cover of the handheld device. In addition, the handheld device 10 can also include an extended system ground plane 30. For convenience of explaining the technical feature of the subject application, the following appearance part 20 is a housing 20, which the subject application is not limited to.

In the embodiment, both the system ground plane and the extended system ground plane 30 are disposed in the housing 20. The electric ground level and the transmission circuit for related signals can extend to the extended system ground plane 30. In more details, the ground point of the system ground plane can extend to a conductive component G1 of the extended system ground plane 30 through a terminal point P1, wherein the conductive component G1 can be seen as a ground point. The feed point of the system ground plane can extend through a coaxial cable to another conductive component F1 of the extended system ground plane 30, wherein the conductive component F1 can be seen as a feed point. The above-mentioned conductive components F1 and G1 are, for example, a spring or a pogo pin. It should be noted that a flexible printed circuit P2 usually serves as a data transmission channel between the system ground plane and the extended system ground plane 30 provided to, for example, a USB port (not shown) or a microphone (not shown). The flexible printed circuit P2 can also have a ground circuit connected between the system ground plane and the extended system ground plane 30.

In generally speaking, limited by the system ground plane, a conventional handheld device is designed to a cuboid shape only. The handheld device 10 in the embodiment takes a scheme of extending the ground plane, and the extended system ground plane 30 can be connected to the system ground plane through a flexible connection part (for example, a flexible printed circuit, elastic connection component). Such scheme is advantageous in making the extended system ground plane 30 and the system ground plane respectively located at different planes. In this way, the extended system ground plane 30 can follow the appearance shape of the handheld device 10 to extend the electric ground level of the system ground plane and the transmission circuit of the related signals to everywhere in the handheld device 10. As a result, each of the spaces of the handheld device 10 can be effectively used, and the appearance design of the handheld device 10 is out of the limitation the system ground plane.

Figure 3:
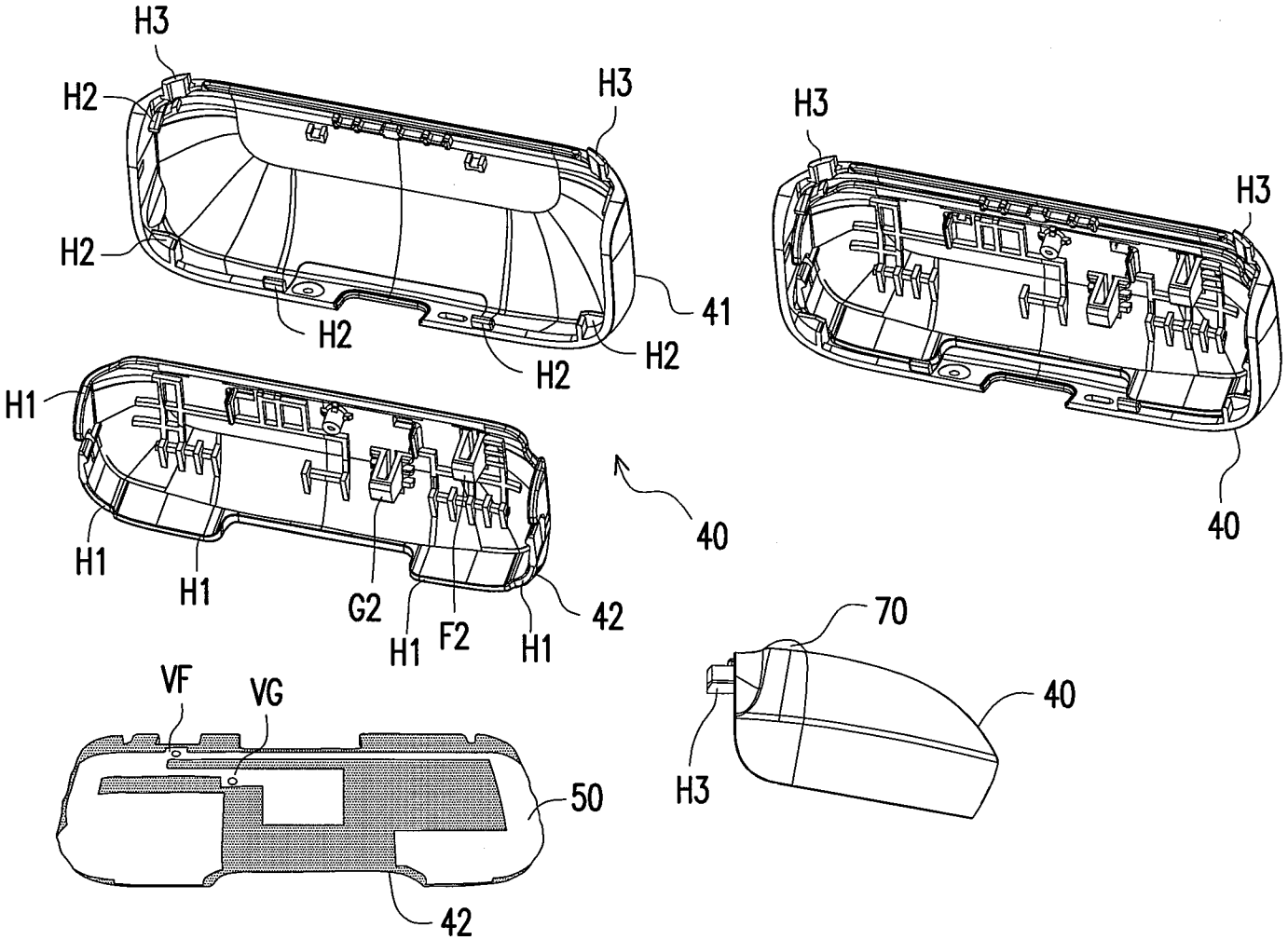
FIG. 3 is a diagram of a detachable element according to the first embodiment of the present invention.
Figure 4:
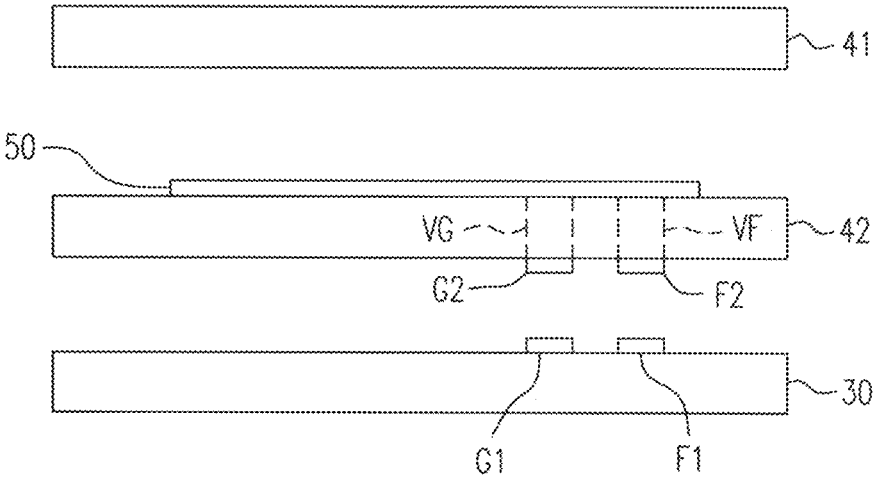
FIG. 4 is a sectional diagram of a detachable element according to the first embodiment of the present invention.

FIG. 3 is a diagram of a detachable element according to the first embodiment of the present invention and FIG. 4 is a sectional diagram of a detachable element according to the first embodiment of the present invention. Referring to FIGS. 1-4, the detachable element 40 includes a carrier 42 and a planar antenna 50. In the embodiment, the detachable element 40 further includes an outer carrier 41, wherein the outer carrier 41 is a portion of the appearance part. The appearance part can be a partial housing, a portion of a back-coverlid or a battery cover of the handheld device. The detachable element 40 can further include a protrusion portion 70 so as to increase the height/volume to the clearance of the planar antenna 50 and thereby a better radiation performance can be obtained.

In the embodiment, the planar antenna 50 is integrated into the carrier 42. For example, the planar antenna 50 is disposed on the surface of the carrier 42 by the spreading/coating process or is inlaid in the carrier 42. The planar antenna 50 can extend to a conductive component F2 of the inner surface of the carrier 42 through the via VF, wherein the conductive component F2 can be seen as the feed point of the planar antenna 50. The planar antenna 50 can extend to a conductive component G2 of the inner surface of the carrier 42 through the via VG, wherein the conductive component G2 can be seen as the ground point of the planar antenna 50. The above-mentioned conductive components F2 and G2 are, for example, a spring or a pogo pin. The above-mentioned spreading/coating process is, for example, MID technology or LDS technology, while the inlaid structure can be implemented by injection moulding technology. In this way, the planar antenna 50 almost does not occupy the space of the system ground plane and the extended system ground plane 30, and the system ground plane and the extended system ground plane 30 can also provide a larger space to accommodate other components.

In the embodiment, the carrier 42 has a locking device H1. The outer carrier 41 has another locking device H2, wherein the locking device H1 is corresponding to the locking device H2. In other words, the locking device H1 and the locking device H2 are locked by each other, and the carrier 42 can lock and be connected to the outer carrier 41 to form the detachable element 40; the carrier 42 can be detached from the outer carrier 41 through unlocking the locking devices H1 and H2 from each other. It should be noted that the disassembled function of the carrier 42 is an option only. In another embodiment, the carrier 42 is not detached.

The outer carrier 41 of the detachable element 40 has a locking device H3 and the housing 20 has a locking device H4. The locking device H3 is corresponding to the locking device H4. In other words, the locking devices H3 and H4 are locked by each other and the detachable element 40 can be connected to the housing 20 to form the back-cover or the battery cover of the handheld device 10; or the detachable element 40 can be detached from the housing 20 through unlocking the locking devices H3 and H4 from each other. It should be noted that the locking devices H1-H4 shown in FIGS. 1 and 3 are an option only, which the subject application is not limited to. Anyone skilled in the art can adopt different locking devices according to the requirements.

When the detachable element 40 is connected to the housing 20, the conductive components F2 and G2 of the carrier 42 can be respectively electrically connected to the conductive components F1 and G1 of the extended system ground plane 30, so that the handheld device 10 can transmit and receive wireless signal through the planar antenna 50.

In FIG. 4, when the carrier 42 is connected to the outer carrier 41, the planar antenna 50 is located between the carrier 42 and the outer carrier 41. The outer carrier 41 can serve as a protection shell for the planar antenna 50. In this way, the planar antenna 50 is unlikely damaged. Since no other electronic component is disposed between the carrier 42 and the outer carrier 41, the planar antenna 50 is thereby unlikely interfered by other electronic components to reduce the radiation performance thereof.

Anyone skilled in the art knows the higher the height of the clearance, the better the radiation performance is. The embodiment disposes the planar antenna 50 on the surface of the carrier 42, so that when the detachable element 40 is connected to the housing 20, a hollow is formed between the carrier 42 and the extended system ground plane 30, wherein the hollow is able to increases the distance between the planar antenna 50 and the extended system ground plane 30 and thereby advance the radiation performance of the planar antenna 50. In order to further increase the height of the clearance, the planar antenna 50 on the carrier 42 can be more skillfully disposed within the region of the protrusion portion 70 to further increase the height of the clearance. The other implementations of disposing the planar antenna 50 within the region of the protrusion portion 70 can refer the depiction in following.

It is well known that the layout pattern of the planar antenna 50 can affect the receiving/transmitting frequency band and the quality thereof. For example, the dimension of the planar antenna 50 (for example, length, width and shape) can be modified so that the planar antenna 50 can well operate at the frequency bands of the Europe wireless communication standard or the USA wireless communication standard. In this regard, the embodiment can design the planar antennas with different layout patterns in association with different detachable elements, wherein the user needs to replace different detachable elements only to change the operating frequency band of the planar antenna. In other words, if the handheld device 10 is equipped with a detachable element of the planar antenna suitable for the Europe wireless communication standard, the handheld device 10 can be used in Europe with good radiation performance; if the handheld device 10 is equipped with a detachable element of the planar antenna suitable for the USA wireless communication standard, the handheld device 10 can be used in USA with good radiation performance effect as well. In short, when a user make travel in different countries, only the detachable element of the handheld device 10 needs to be changed to a corresponding one so that the handheld device 10 can be adapted to the communication specifications of different countries.

Figure 5:
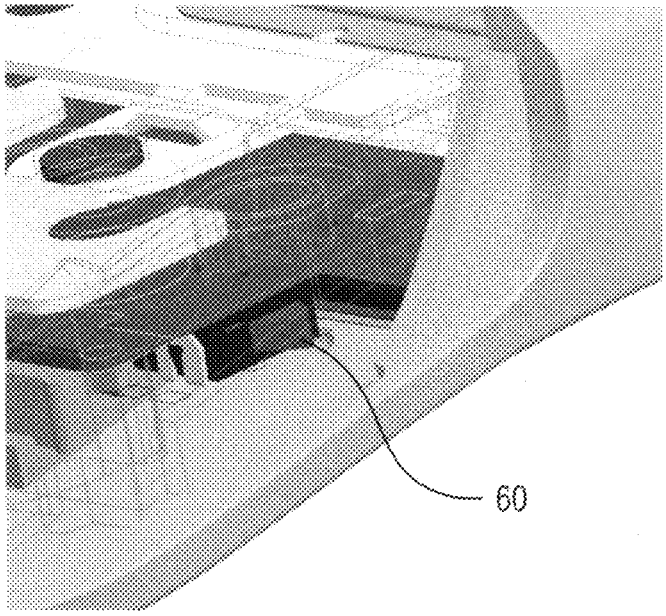
FIG. 5 is a diagram of a sensing component according to the first embodiment of the present invention.

FIG. 5 is a diagram of a sensing component according to the first embodiment of the present invention. It should be noted that if the detachable element 40 is not connected to the housing 20 yet, it is possible the planar antenna 50 fails to be connected to the extended system ground plane 30 and the radiation performance of the handheld device 10 will significantly drop. To avoid the above-mentioned problem, in the embodiment, the handheld device 10 further includes a sensing component 60, wherein the sensing component 60 is, for example, a spring reset switch, which the present invention is not limited to. In other embodiments, the sensing component 60 can be other types of switch, having a function to output a detection signal.

The sensing component 60 can be disposed on the extended system ground plane 30 for detecting whether or not the detachable element 40 does be connected to the housing 20 and accordingly outputting the detection signal to the extended system ground plane 30. In more details, when the detachable element 40 is certainly connected to the housing 20, the sensing component 60 is triggered and then a normal detection signal is provided to the extended system ground plane 30 and handheld device 10 would not send out a warning. If the detachable element 40 does not be connected to the housing 20, the sensing component 60 is unable to be triggered and an abnormal detection signal is sent to the extended system ground plane 30. The handheld device 10 displays the above-mentioned abnormal detection signal on the screen or sends out a warning voice to remind the user to re-install the detachable element 40.

In addition, in the embodiment, the detachable element 40 has also a protection function. Anyone skilled in the art can dispose the battery of the handheld device 10, a data transmission port, a slot of SIM or a slot of memory card on the region of the extended system ground plane 30 under the detachable element 40. In this way, the handheld device 10 does not need to dispose protection cover for the battery of the handheld device 10, the data transmission port, the slot of SIM or the slot of memory card.

Although the above-mentioned embodiment has described a feasible implementation, but anyone skilled in the art should know various manufactures have different designs of the handheld devices, and accordingly the subject application is not limited to the above-mentioned design. In other words, whenever the planar antenna is integrated into the detachable element with assembly/disassembly function, the design has fallen in the spirit of the subject application. More embodiments are described as follows for anyone skilled in the art to further understand the spirit of the subject application and to implement the subject application.

In the first embodiment, although the handheld device 10 is described targeting a planar inverted F antenna (PIFA), but the subject application is not limited thereto. In fact, the scheme of the above-mentioned embodiment can be applied in a handheld device with a monopole antenna as well.

In the first embodiment, the design that the handheld device 10 includes an extended system ground plane 30 is only an option design. In other embodiments, the handheld device 10 can comprise only a system ground plane but without the extended system ground plane 30. When the detachable element 40 is connected to the housing 20, the planar antenna 50 can be electrically connected to the system ground plane through the conductive components G1, G2, F1 and F2 and has the same effect of the first embodiment.

Figure 6A:
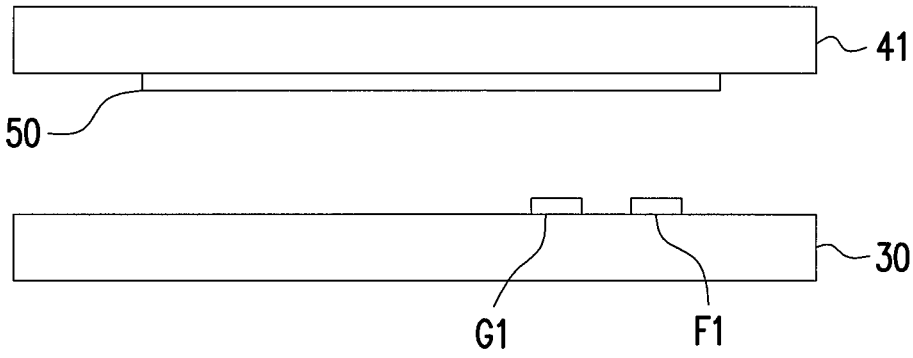
FIG. 6A is a sectional diagram of a detachable element according to the second embodiment of the present invention.

In the first embodiment, the design of FIG. 4 is also an option implementation, anyone skilled in the art can implement the detachable element in other ways according to the requirement. For example, the design of FIG. 6A is feasible as well. FIG. 6A is a sectional diagram of a detachable element according to the second embodiment of the present invention. In the embodiment, the carrier 42 is omitted and the planar antenna 50 is disposed at the inner surface of the outer carrier 41 of the detachable element 40, which is not only to simplify the hardware architecture, but also save the process to form the via at the carrier 42.

Figure 6B:
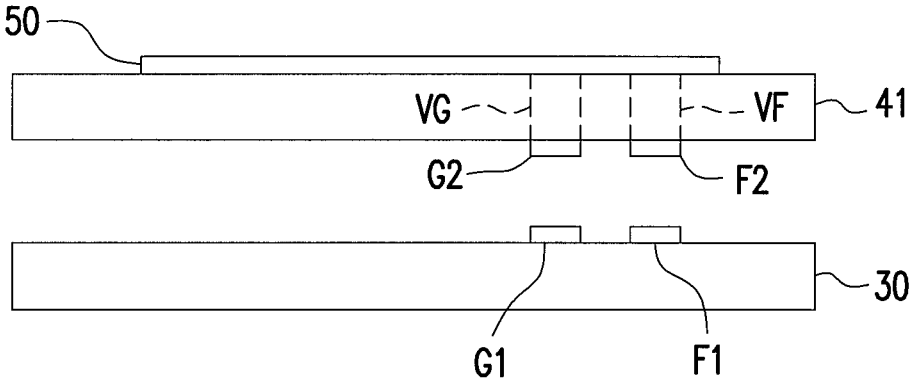
FIG. 6B is a sectional diagram of a detachable element according to the third embodiment of the present invention.

FIG. 6B is a sectional diagram of a detachable element according to the third embodiment of the present invention. In the embodiment, carrier 42 of FIG. 4 is saved and the planar antenna 50 is disposed at the outer surface of the outer carrier 41 of the detachable element 40. In order to make the planar antenna 50 electrically connected to the extended system ground plane 30 at the inner side of the outer carrier 41, in the embodiment, the vias VG and VF are formed on the outer carrier 41, which is advantageous in not only simplifying the hardware architecture but also increasing the distance between the planar antenna 50 and the extended system ground plane 30 and enhancing the radiation performance of the planar antenna 50. In addition, the vias VG and VF can serve as strap holes. If the sound-in component such as a microphone is disposed at the extended system ground plane 30 at the inner side of the outer carrier 41, the vias VG and VF can serve as sound-in holes.

Moreover, a protection layer (not shown) can be formed on the planar antenna 50 and the outer carrier 41. The protection layer can be, for example, spray-paint. The protection layer functions not only to avoid the planar antenna 50 from being damaged, but also to prevent the user to touch the planar antenna 50 to interfere the radiation performance of the planar antenna 50. The protection layer can be, for example, transparent or semi-transparent materials, so that the user can see the shape of the planar antenna 50 and make the handheld device 10 have both aesthetic feeling and technology sense.

Figure 6C:
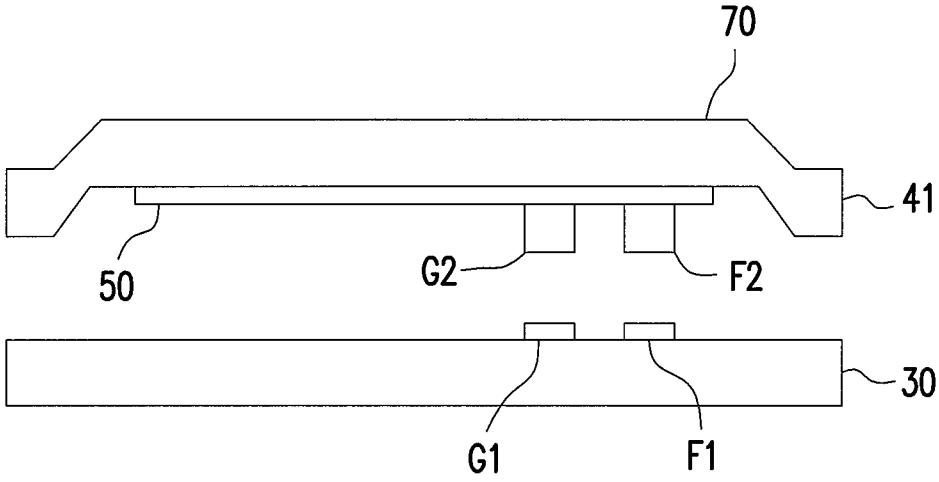
FIG. 6C is a sectional diagram of a detachable element according to the fourth embodiment of the present invention.
Figure 6D:
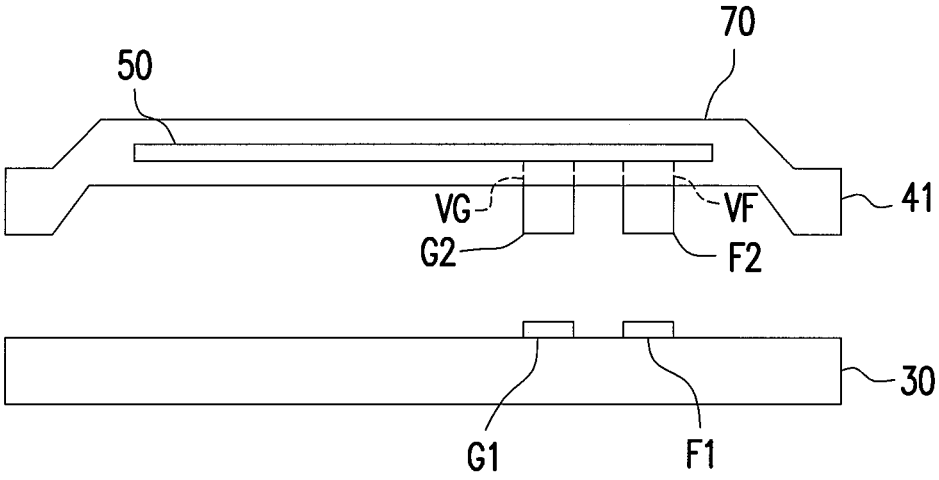
FIG. 6D is a sectional diagram of a detachable element according to the fifth embodiment of the present invention.
Figure 6E:
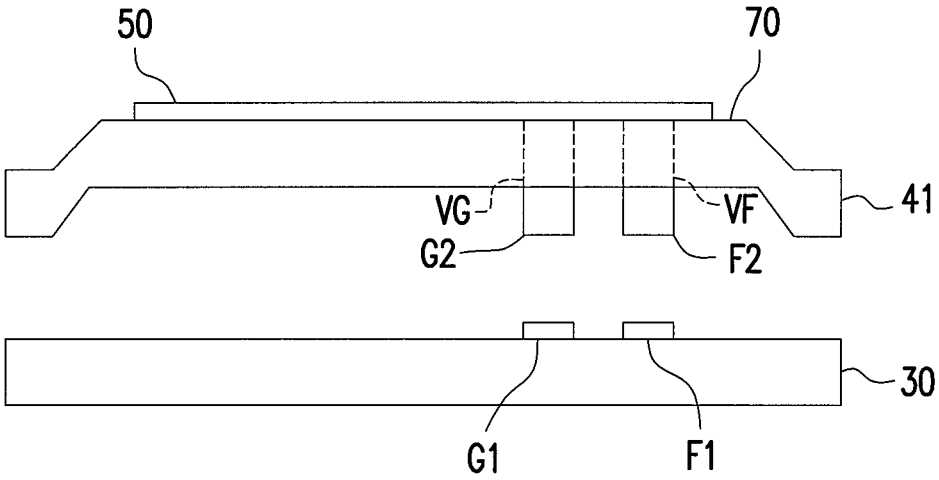
FIG. 6E is a sectional diagram of a detachable element according to the sixth embodiment of the present invention.

FIGS. 6C-6E are sectional diagrams of a detachable element according to the fourth to sixth embodiments of the present invention. In FIGS. 6C-6E, the carrier 42 of FIG. 4 is omitted, but a protrusion portion 70 opposite to the extended system ground plane 30 is formed on the outer carrier 41 of the detachable element 40 (the diagram herein is somehow exaggerated to better display the detail structure thereof). It should be noted that the planar antenna 50 of the embodiment can extend and be disposed in the region of the protrusion portion 70. The planar antenna 50 in FIG. 6C can be disposed at the inner surface of the protrusion portion 70 of the carrier 42; the planar antenna 50 in FIG. 6D can be embedded in the inner layer of the protrusion portion 70 of the carrier 42; the planar antenna 50 in FIG. 6E can be disposed at the outer surface of the protrusion portion 70 of the carrier 42. In the above-mentioned three designs, the planar antenna 50 extends and is disposed in the region of the protrusion portion 70, so that the distance between the planar antenna 50 and the extended system ground plane 30 can be further increased and thereby the radiation performance of the planar antenna 50 is further enhanced. Not only that, when the outer carrier 41 of the detachable element 40 is disposed at the housing 20 or detached from the housing 20, the protrusion portion 70 can serve as the force-applying point of the finger of the user to facilitate the disassembly of the outer carrier 41 by the user.

In summary, the subject application provides a scheme that different planar antennas are integrated into different detachable elements, which is not only to improve the space occupied by the planar antenna and the desired radiation performance, but also to enable the user to change the operating frequency band of the antenna of the handheld device by replacing the detachable element. In addition, the embodiments of the subject application have the following features and advantages.

1. By forming the protrusion portion of the detachable element located at a place opposite to the system ground plane and extending the planar antenna to the protrusion portion, the distance between the planar antenna and the system ground plane can be further increased so as to enhance the radiation performance of the planar antenna, wherein the protrusion portion can also serve as a force-applying point so that the user easily detaches the detachable element.
2. The vias of the outer carrier function not only to extend the planar antenna from the outer surface of the outer carrier to the inner surface, but also to serve as strap holes or sound-in holes.
3. The detachable element has the protection function, i.e., the battery of the handheld device, the data transmission port, the slot of SIM or the slot of memory card can be disposed on the region of the extended system ground plane under the detachable element. In this way, the handheld device does need to dispose protection covers for the battery of the handheld device, the data transmission port, the slot of SIM or the slot of memory card.
4. The design that the planar antenna is disposed on the carrier, followed by connecting the carrier to the outer carrier enables the planar antenna located between the carrier and the outer carrier. In this way, the carrier and the outer carrier serve as the protection shell for the planar antenna to avoid the planar antenna damaged.
5. By disposing the sensing component at the handheld device it is advantageous in that when the detachable element does not be connected to the housing, the handheld device would send out a warning to remind the user.

It will be apparent to those skilled in the art that the descriptions above are several preferred embodiments of the present invention only, which does not limit the implementing range of the present invention. Various modifications and variations can be made to the structure of the present invention without departing from the scope or spirit of the invention. In addition, any one of the embodiments or claims of the present invention is not necessarily achieve all of the above-mentioned objectives, advantages or features.

What is claimed is:

1. A handheld device, comprising:

an appearance part;

a system ground plane, disposed in the appearance part and having a feed point; and a detachable element, comprising:

a carrier, detachably connected to the appearance part; and a planar antenna, disposed on the carrier and having a first connection point, wherein when the carrier is connected to the appearance part, the first connection point is electrically connected to the feed point, wherein the carrier of the detachable element has a protrusion portion opposite to the system ground plane, the planar antenna extends into and is disposed within the region of the protrusion portion such that a height or volume of clearance between the system ground plane and the planar antenna disposed within the region of the protrusion portion is increased compared with the planar antenna being disposed within the carrier but not disposed within the region of the protrusion portion, wherein the protrusion portion comprises a central panel, at least one bevel edge and an outside panel, the at least one bevel edge is disposed between the central panel and the outside panel, the central panel is protruded from an outer surface of the appearance part, the outside panel and the outer surface of the appearance part are co-planed, a surface of the central panel is parallel to the outer surface of the appearance part, and a distance between the central panel and the ground plane is greater than a distance between the outside panel and the ground plane, wherein when the carrier is connected to the appearance part or detached from the appearance part, the at least one bevel edge of the protrusion portion serves as a force-applying point.

2. The handheld device as claimed in claim 1, wherein the planar antenna is disposed at an inner surface or an outer surface of the protrusion portion of the carrier or embedded in an inner layer of the protrusion portion of the carrier.

3. The handheld device as claimed in claim 1, wherein the system ground plane further has a ground point and the planar antenna further has a second connection point, when the carrier is connected to the appearance part, the second connection point is electrically connected to the ground point.

4. The handheld device as claimed in claim 1, wherein the carrier includes at least a via, the planar antenna extends to an inner surface of the carrier from an outer surface of the carrier through the via, and the first connection point is located at the inner surface of the carrier.

5. The handheld device as claimed in claim 4, wherein the via serves as strap hole, sound-in hole or sound-out hole.

6. The handheld device as claimed in claim 1, wherein the planar antenna is disposed at the carrier by means of moulded interconnect device technology or laser direct structuring technology.

7. The handheld device as claimed in claim 1, wherein the planar antenna is inlaid in the carrier by means of injection moulding technology.

8. The handheld device as claimed in claim 1, wherein the appearance part comprises a housing, a portion of a housing or an element connected to a housing.

9. The handheld device as claimed in claim 1, wherein the appearance part comprises a first locking device, the detachable element further comprises a second locking device, and the second locking device is used to lock or unlock the first locking device so that the carrier is connected to the appearance part or detached from the appearance part.

10. The handheld device as claimed in claim 1, further comprising:

a conductive component disposed on the system ground plane and electrically connected to the feed point, wherein when the carrier is connected to the appearance part, the first connection point is electrically connected to the feed point through the conductive component.

11. The handheld device as claimed in claim 10, wherein the conductive component is a spring or a pogo pin.

12. The handheld device as claimed in claim 1, further comprising:

a conductive component disposed on the carrier and electrically connected to the first connection point, wherein when the carrier is connected to the appearance part, the first connection point is electrically connected to the feed point through the conductive component.

13. The handheld device as claimed in claim 1, further comprising:

a sensing component disposed on the system ground plane for detecting whether or not the detachable element is connected to the appearance part and thereby outputting a detection signal to the system ground plane.

14. The handheld device as claimed in claim 1, wherein the detachable element is a portion of the appearance part, or a back-cover or a battery cover of the handheld device.

15. A handheld device, comprising:

an appearance part;

a system ground plane, disposed in the appearance part and having a feed point; and a detachable element, comprising:

an outer carrier, detachably connected to the appearance part;

a carrier, connected to the outer carrier; and a planar antenna, disposed on the carrier and having a connection point, wherein when the carrier is connected to the appearance part through the outer carrier, the connection point is electrically connected to the feed point, wherein the carrier of the detachable element has a protrusion portion opposite to the system ground plane, the planar antenna extends into and is disposed within the region of the protrusion portion a height or volume of clearance between the system ground plane and the planar antenna disposed within the region of the protrusion portion is increased compared with the planar antenna being disposed within the carrier but not disposed within the region of the protrusion portion, wherein the protrusion portion comprises a central panel, at least one bevel edge and an outside panel, the at least one bevel edge is disposed between the central panel and the outside panel, the central panel is protruded from an outer surface of the appearance part, the outside panel and the outer surface of the appearance part are co-planed, a surface of the central panel is parallel to the outer surface of the appearance part, and a distance between the central panel and the ground plane is greater than a distance between the outside panel and the ground plane, wherein when the carrier is connected to the appearance part or detached from the appearance part, the at least one bevel edge of the protrusion portion serves as a force-applying point.

16. The handheld device as claimed in claim 15, wherein the carrier is detachably connected to the outer carrier.

17. A handheld device, comprising:

an appearance part;

a system ground plane, disposed in the appearance part and having a feed point; and an extended system ground plane, disposed in the appearance part and having a first connection point, wherein the first connection point is electrically connected to the feed point;

a detachable element, comprising:

a carrier, detachably connected to the appearance part; and a planar antenna, disposed on the carrier and having a second connection point, wherein when the carrier is connected to the appearance part, the second connection point is electrically connected to the feed point through the first connection point, wherein the carrier of the detachable element has a protrusion portion opposite to the system ground plane, the planar antenna extends into and is disposed within the region of the protrusion portion such that a height or volume of clearance between the system ground plane and the planar antenna disposed within the region of the protrusion portion is increased compared with the planar antenna being disposed within the carrier but not disposed within the region of the protrusion portion, wherein the protrusion portion comprises a central panel, at least one bevel edge and an outside panel, the at least one bevel edge is disposed between the central panel and the outside panel, the central panel is protruded from an outer surface of the appearance part, the outside panel and the outer surface of the appearance part are co-planed, a surface of the central panel is parallel to the outer surface of the appearance part, and a distance between the central panel and the ground plane is greater than a distance between the outside panel and the ground plane, wherein when the carrier is connected to the appearance part or detached from the appearance part, the at least one bevel edge of the protrusion portion serves as a force-applying point.

18. A handheld device, comprising:

an appearance part;

a system ground plane, disposed in the appearance part and having a feed point;

a first detachable element with a first layout pattern; and a second detachable element with a second layout pattern; wherein the first detachable element or the second detachable element is alternatively connected to the appearance part, and the first layout pattern and the second layout pattern are different from each other; and wherein the first detachable element, comprising:

a first carrier, detachably connected to the appearance part; and a first planar antenna, disposed on a surface of the first carrier by a spreading or coating process according to the first layout pattern and having a first connection point, wherein when the first carrier is connected to the appearance part, the first connection point is electrically connected to the feed point, wherein the first carrier of the first detachable element has a first protrusion portion opposite to the system ground plane, the first planar antenna extends into and is disposed within the region of the first protrusion portion such that a height or volume of clearance between the system ground plane and the first planar antenna disposed within the region of the first protrusion portion is increased compared with the first planar antenna being disposed within the first carrier but not disposed within the region of the first protrusion portion, wherein the first protrusion portion comprises a first central panel, at least one first bevel edge and a first outside panel, the at least one first bevel edge is disposed between the first central panel and the first outside panel, the first central panel is protruded from a outer surface of the appearance part, the first outside panel and the outer surface of the appearance part are co-planed, a first surface of the first central panel is parallel to the outer surface of the appearance part, and a distance between the first central panel and the ground plane is greater than a distance between the first outside panel and the ground plane, wherein when the first carrier is connected to the appearance part or detached from the appearance part, the at least one first bevel edge of the first protrusion portion serves as a force-applying point; and the second detachable element, comprising:

a second carrier, detachably connected to the appearance part; and a second planar antenna, disposed on a surface of the second carrier by the spreading or coating process according to the second layout pattern and having a second connection point, wherein when the second carrier is connected to the appearance part, the second connection point is electrically connected to the feed point, wherein the second carrier of the second detachable element has a second protrusion portion opposite to the system ground plane, the second planar antenna extends into and is disposed within the region of the second protrusion portion such that a height or volume of clearance between the system ground plane and the second planar antenna disposed within the region of the second protrusion portion compared with the second planar antenna being disposed within the second carrier but not disposed within the region of the second protrusion portion, wherein the second protrusion portion comprises a second central panel, at least one second bevel edge and a second outside panel, the at least one second bevel edge is disposed between the second central panel and the second outside panel, the second central panel is protruded from the outer surface of the appearance part, the second outside panel and the outer surface of the appearance part are co-planed, a second surface of the second central panel is parallel to the outer surface of the appearance part, and a distance between the second central panel and the ground plane is greater than a distance between the second outside panel and the ground plane, wherein when the second carrier is connected to the appearance part or detached from the appearance part, the at least one second bevel edge of the second protrusion portion serves as the force-applying point.

* * * * *